US005595965A

United States Patent [19]

Wiggins

[11] Patent Number: 5,595,965

[45] Date of Patent: Jan. 21, 1997

[54] BIODEGRADABLE VEGETABLE OIL GREASE

[75] Inventor: Gary W. Wiggins, Willowick, Ohio

[73] Assignee: The Lubrizol Corporation, Wickliffe, Ohio

[21] Appl. No.: 646,662

[22] Filed: May 8, 1996

[51] Int. Cl.[6] ..... C10M 117/00; C10M 105/38

[52] U.S. Cl. ..... 508/491; 508/486; 508/539

[58] Field of Search ..... 508/486, 491

[56] References Cited

U.S. PATENT DOCUMENTS

| | | | |
|---|---|---|---|
| 3,242,088 | 3/1966 | Bright et al. | 252/41 |
| 3,579,548 | 5/1971 | Whyte | 508/486 |
| 4,392,967 | 7/1983 | Alexander | 252/41 |
| 4,597,881 | 7/1986 | Iseya et al. | 252/41 |
| 4,631,136 | 12/1986 | Jones, III | 252/8.5 M |
| 4,783,274 | 11/1988 | Jokinen et al. | 252/32.7 E |
| 4,902,435 | 2/1990 | Waynick | 252/18 |
| 5,282,989 | 2/1994 | Erickson et al. | 252/48.2 |
| 5,300,242 | 4/1994 | Nichols et al. | 252/38 |
| 5,338,471 | 8/1994 | Lal | 508/491 |
| 5,350,531 | 9/1994 | Musilli | 252/41 |
| 5,358,652 | 10/1994 | Macpherson | 252/51.5 R |
| 5,413,725 | 5/1995 | Lal et al. | 252/18 |
| 5,427,700 | 6/1995 | Stoffa | 508/491 |
| 5,427,704 | 6/1995 | Lawate | 508/491 |
| 5,538,654 | 7/1996 | Lawate et al. | 508/308 |

*Primary Examiner*—Ellen M. McAvoy
*Attorney, Agent, or Firm*—James L. Cordek; Frederick D. Hunter; Joseph P. Fischer

[57] ABSTRACT

An environmentally friendly lubricating grease composition as well as several processes for preparing the grease composition is desecribed which comprises (A) a base oil wherein the base oil is a natural oil or synthetic triglyceride of the formula

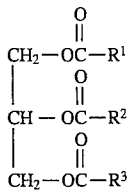

wherein $R^1$, $R^2$ and $R^3$ are aliphatic groups that contain from about 7 to about 23 carbon atoms and (B) a thickener wherein the thickener (B) is a reaction product of (B1) a metal based material and (B2) a carboxylic acid or its ester, wherein the metal based material (B1) comprises a metal oxide, metal hydroxide, metal carbonate or metal bicarbonate, wherein the metal is an alkali or alkaline earth metal and wherein the carboxylic acid (B2) is of the formula $R^4(COOR^5)_n$ where $R^4$ is an aliphatic or hydroxy substituted aliphatic group that contains from 4 to about 29 carbon atoms, $R^5$ is hydrogen or an aliphatic group containing from 1 to 4 carbon atoms and n is an integer of from 1 to 4, wherein the equivalent ratio of (B1):(B2) is from about 0.70–1.10 and wherein the weight ratio of the base oil to the sum of the metal based material and the carboxylic acid is from 50:50 to 95:5.

44 Claims, No Drawings

BIODEGRADABLE VEGETABLE OIL GREASE

FIELD OF THE INVENTION

This invention relates to a vegetable oil, non-mineral oil grease and a process for preparing the same. A thickener is prepared in situ within the oil and the thickener is an alkali or alkaline earth metal carboxylate.

BACKGROUND OF THE INVENTION

Grease manufacturers have attempted to prepare biodegradable alkali and alkaline earth metal greases from vegetable oils with limited success. The high temperatures required degrades the vegetable oil thickener substrate and vegetable oil diluent. The only success is in using mineral oil during the formation of the thickener, then adding vegetable oil as a diluent.

U.S. Pat. No. 3,242,088 (Bright et al., Mar. 22, 1966) provides a low temperature method for the preparation of soap thickened greases, wherein increased yields and improved product quality are obtained. The method of this reference involves essentially carrying out the saponification step of the grease making process by slowly introducing a solution or slurry of metal base into a recirculating stream of lubricating oil and saponifiable material at an elevated temperature sufficient to produce a rapid reaction between the metal base and the saponifiable material and thereafter subjecting the recirculated stream to turbulent mixing before returning it to the main body of saponification mixture. Very advantageously, the stream may be subjected to shearing, most suitably by passing it through a shear valve with at least a substantial pressure drop across the valve. The process representing the preferred embodiment of this reference comprises recirculating the grease mixture in the same manner during the subsequent heating at higher temperatures, with shearing by means of a shear valve during at least a portion of the further heating step.

U.S. Pat. No. 4,392,967 (Alexander, Jul. 12, 1983) provides a process for continuously manufacturing a lubricating grease using a screw process unit comprising:

(a) introducing feed materials and lubricating oil into selected locations of a screw process unit which contains a series of adjacent, longitudinally connected barrel sections for performing different operative steps and houses a rotating screw device traversing the interior of the barrel sections and having separate elements along its length to perform desired operations;

(b) mixing and conveying said feed materials along said process unit through the adjacent barrel sections by continuous operation of said rotating screw;

(c) controlling the temperature of said material while it is being conveyed through said process unit by use of various heat exchange means which are located in or adjacent each barrel to said in carrying out the operative steps of dispersion, reaction, dehydration and/or homogenization;

(d) venting water resulting from the dehydration of the feed mixture at selected barrel discharge points in said process unit;

(e) introduction of additional lubricating oil and/or additives at downstream barrel locations following the dehydration step;

(f) homogenization of said complete grease formulation by continued rotation of said screw device; and (g) removal of the finished lubricating grease from the end barrel section of said screw process unit.

U.S. Pat. No. 4,597,881 (Iseya et al., Jul. 1, 1986) provides a process for producing a lithium-soap grease which comprises:

adding a hydroxy-fatty acid having from 12 to 24 carbon atoms, and a dicarboxylic acid having from 8 to 10 carbon atoms to a base oil (I) having an aniline point of from 100° to 130° C. at a temperature of less than 100° C. with stirring to prepare a uniform dispersion of said acids in the base oil (I);

adding lithium hydroxide to said uniform dispersion with stirring;

reacting said acids and lithium hydroxide and dehydrating by heating to a temperature of 195° to 210° C.;

cooling the reaction mixture to a temperature not higher than about 160° C. at a cooling rate of from about 20° to 80° C./hour; and adding a base oil (II) having an aniline point of from 130° to 140° C. to the reaction mixture for a period of from 10 seconds to 30 minutes in an amount so that the weight ratio of the base oil (I) to the base oil (II) is from 30:70 to 60:40 and the resulting mixture of the base oils (I) and (II) has a dynamic viscosity as determined at 100° C. of from 5 to 50 centistokes and an aniline point of from 125° to 135° C. to produce said lithium-soap grease.

U.S. Pat. No. 4,902,435 (Waynick, Feb. 20, 1990) relates to a lubricating grease which is particularly useful for front-wheel drive joints. The grease displayed good results over prior art greases. The grease provides superior wear protection from sliding, rotational, and oscillatory (fretting) motions in front wheel drive joints. It is also chemically compatible with elastomers and seals in front-wheel drive joints. It further resists chemical corrosion, deformation, and degradation of the elastomers and extends the useful life of CV (constant velocity) drive joints.

U.S. Pat. No. 5,350,531 (Musilli, Sep. 27, 1994) provides a process for preparing a 12-hydroxy calcium lithium stearate grease. In the first step of the process, 12-hydroxy stearic acid is mixed with a first portion of a paraffin bright stock oil and thereafter heated to a temperature of from about 170 to about 200 degrees Fahrenheit. Thereafter, lithium hydroxide and calcium hydroxide are added to the mixture, the mixture is then heated to a temperature of from about 360 to about 450 degrees Fahrenheit and saponified, and then the product is comminuted. The comminuted mixture is then mixed with a second portion of lubricating oil.

SUMMARY OF THE INVENTION

An environmentally friendly lubricating grease is disclosed, which comprises (A) a base oil wherein the base oil is a natural oil or synthetic triglyceride of the formula

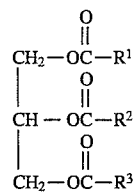

wherein $R^1$, $R^2$ and $R^3$ are aliphatic groups that contain from about 7 to about 23 carbon atoms and (B) a thickener wherein the thickener (B) is a reaction product of (B1) a metal based material and (B2) a carboxylic acid or its ester, wherein the metal based material (B1) comprises a metal oxide, metal hydroxide, metal carbonate or metal bicarbonate, wherein the metal is an alkali or alkaline earth metal and wherein the carboxylic acid (B2) is of the formula $R^4(COOR^5)_n$ where $R^4$ is an aliphatic or hydroxy substituted aliphatic group that contains from 4 to about 29 carbon atoms, $R^5$ is hydrogen or an aliphatic group containing from 1 to 4 carbon atoms and n is an integer of from 1 to 4, wherein the equivalent ratio of (B1):(B2) is from about 0.70–1.10 and wherein the weight ratio of the base oil to the sum of the metal based material and the carboxylic acid is from 50:50 to 95:5.

Also disclosed are several processes for preparing an environmentally friendly grease, comprising the steps of (a) mixing (A), (B1) and (B2) thereby provididng a mixture;

(b) heating said mixture to a temperature of from 82° C. to about 105° C. to form (B);

(c) heating the mixture to a final temperature of about 145° C. for an alkaline metal or to about 200° C. for an alkali metal; and (d) cooling the mixture to form a grease.

In another process embodiment, an environmentally friendly alkaline earth metal or alkali metal grease is prepared, comprising the steps of (a) mixing (A), (B1) and (B2) thereby providing a first mixture;

(b) heating said first mixture to a temperature of from 82° C. to about 105° C. to form (B) thereby providing a first heated mixture;

(c) heating the first heated mixture to a final temperature of about 145° C. for an alkaline metal or to about 200° C. for an alkali metal;

(d) adding at 110°–145° C. for an alkali earth metal or 170°–200° C. for an alkali metal, subsequent portions of (A) to provide a second mixture; and (e) permitting this mixture to cool to form a grease.

In the above processes, components (A), (B), (B1) and (B2) are as earlier defined.

DETAILED DESCRIPTION OF THE INVENTION (A) The Base Oil

In practicing this invention, the base oil is a synthetic triglyceride or a natural oil of the formula

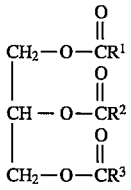

wherein $R^1$, $R^2$ and $R^3$ are aliphatic hydrocarbyl groups that contain from about 7 to about 23 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups; thin is, alkyl groups such as heptyl, nonyl, undecyl, tridecyl, heptadecyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

Naturally occurring triglycerides are vegetable oil triglycerides. The synthetic triglycerides are those formed by the reaction of one mole of glycerol with three moles of a fatty acid or mixture of fatty acids. In preparing a synthetic triglyceride, the fatty acid contains from 8 to 24 carbon atoms. Preferably the fatty acid is oleic acid, linoleic acid, linolenic acid or mixtures thereof. Most preferably, the fatty acid is oleic acid. Of the vegetable oil triglycerides and the synthetic triglycerides, preferred are vegetable oil triglycerides. The preferred vegetable oils are soybean oil, rapeseed oil, sunflower oil, coconut oil, lesquerella oil, canola oil, peanut oil, safflower oil and castor oil.

In a preferred embodiment, the aliphatic hydrocarbyl groups are such that the triglyceride has a monounsaturated character of at least 60 percent, preferably at least 70 percent and most preferably at least 80 percent. Naturally occurring triglycerides having utility in this invention are exemplified by vegetable oils that are genetically modified such that they contain a higher than normal oleic acid content. Normal sunflower oil has an oleic acid content of 25–30 percent. By genetically modifying the seeds of sunflowers, a sunflower oil can be obtained wherein the oleic content is from about 60 percent up to about 90 percent. That is, the $R^1$, $R^2$ and $R^3$ groups are heptadecenyl groups and the $R^1COO^-$, $R^2COO^-$ and $R^3COO^-$ to the 1,2,3-propanetriyl group $—CH_2CHCH_2—$ are the residue of an oleic acid molecule. U.S. Pat. No. 4,627,192 and U.S. Pat. No. 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 13% palmitic acid, and 7% linoleic acid, the monounsaturated content is 70%. The preferred triglyceride oils are high oleic acid, that is, genetically modified vegetable oils (at least 60 percent) triglyceride oils. Typical high oleic vegetable oils employed within the instant invention are high oleic safflower oil, high oleic canola oil, high oleic peanut oil, high oleic corn oil, high oleic rapeseed oil, high oleic sunflower oil and high oleic soybean oil. Canola oil is a variety of rapeseed oil containing less than 1 percent erucic acid. A preferred high oleic vegetable oil is high oleic sunflower oil obtained from *Helianthus sp.* This product is available from SVO Enterprises Eastlake, Ohio as Sunyl® high oleic sunflower oil. Sunyl 80 is a high oleic triglyceride wherein the acid moieties comprise 80 percent oleic acid. Another preferred high oleic vegetable oil is high oleic rapeseed oil obtained from *Brassica campestris* or *Brassica napus*, also available from SVO Enterprises as RS high oleic rapeseed oil. RS80 oil signifies a rapeseed oil wherein the acid moieties comprise 80 percent oleic acid.

It is further to be noted that genetically modified vegetable oils have high oleic acid contents at the expense of the di-and tri- unsaturated acids. A normal sunflower oil has from 20–40 percent oleic acid moieties and from 50–70 percent linoleic acid moieties. This gives a 90 percent content of mono- and di- unsaturated acid moieties (20+70) or (40+50). Genetically modifying vegetable oils generate a low di- or tri- unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

In another embodiment, the genetically modified vegetable oil can be sulfurized. While the sulfurization of compounds containing double bonds is old in the art, the sulfurization of a genetically modified vegetable oil must be done in a manner that total vulcanization does not occur. A direct sulfurization done by reacting the genetically modified vegetable oil with sulfur will give a vulcanized product wherein if the product is not solid, it would have an extremely high viscosity. This would not be a suitable base oil (A) for the preparation of a grease. Other methods of sulfurization are known to those skilled in the art. A few of these sulfurization methods are sulfur monochloride; sulfur dichloride; sodium sulfide/$H_2S$/sulfur; sodium sulfide/$H_2S$; sodium sulfide/sodium mercaptide/sulfur and sulfurization utilizing a chain transfer agent. A particularly preferred sulfurized genetically modified vegetable oil is a sulfurized Sunyl 80® oil available from Hornett Brothers.

The sulfurized genetically modified vegetable oil has a sulfur level generally from 5 to 15 percent by weight, preferably from 7 to 13 percent by weight and most preferably from 8.5 to 11.5 percent by weight.

Utilizing a sulfurized genetically modified vegetable oil as component (A) is a way to prepare a grease having additional antiwear or load carrying abilities.

Component (A) may be all genetically modified vegetable oil, all sulfurized genetically modified vegetable oil or a mixture of sulfurized genetically modified vegetable oil and genetically modified vegetable oil. When a mixture is employed, the ratio of genetically modified vegetable oil to sulfurized genetically modified vegetable oil is from 85:15 to 15:85.

(B) The Thickener

The thickener is a metal salt formed by the reaction of (B1) a metal based material and (B2) a carboxylic acid.

(B1) The Metal Based Material

The metal based material (B1) is a metal oxide, metal hydroxide, metal carbonate or metal bicarbonate. Preferred are metal hydroxides. The metal is an alkali or an alkaline earth metal. Alkali metals of interest are lithium, sodium and potassium. The alkaline earth metals of interest are magnesium, calcium and barium. The preferred metal hydroxides are lithium hydroxide and calcium hydroxide.

(B2) The Carboxylic Acid or Its Ester

The carboxylic acid or its ester (B2) is of the formula $R^4(COOR^5)_n$ wherein $R^4$ is an aliphatic or hydroxy substituted aliphatic group that contains from 4 to 29 carbon atoms, $R^5$ is hydrogen or an aliphatic group that contains from 1 to 4 carbon atoms and n is an integer of from 1 to 4. When $R^4$ is an aliphatic group, preferably $R^4$ contains from 12 to 24 carbon atoms and n is 1 or 2. A nonexhaustive but illustrative list of these aliphatic groups is as follows: the isomeric heptyls, the isomeric heptenyls, the isomeric octyls and octenyls, the isomeric nonyls and nonenyls, the isomeric dodecyls and dodecenyls, the isomeric undecyls and undecenyls, the isomeric tridecyls and tridecenyls, the isomeric pentadecyls and pentadecenyls, the isomeric heptadeceyls and heptadecenyls and the isomeric nonadecyls and nonadecenyls. When $R^4$ and $R^5$ are both aliphatic groups, $R^5$ preferably is a methyl group. When $R^4$ is an aliphatic group, $R^5$ is hydrogen and n is 1, the preferred carboxylic acids are caprylic acid, capric acid, lauric acid, myristic acid, palmitic acid, stearic acid and oleic acid. When $R^4$ is an aliphatic group and n is 2, the preferred dicarboxylic acids are azelaic acid and sebacic acid.

The $R^4$ group may also be a mono-hydroxy substituted or di-hydroxy substituted aliphatic group. When $R^4$ is a mono-hydroxy substituted or di-hydroxy substituted aliphatic group and $R^5$ is hydrogen, it is preferred that n be equal to 1. This then gives rise to mono-hydroxy or di-hydroxy substituted mono-carboxylic acids. The preferred mono-hydroxy substituted aliphatic monocarboxylic acids are 6-hydroxy-stearic acid, 12-hydroxystearic acid, 14-hydroxystearic acid, 16-hydroxystearic acid, ricinoleic acid, and 14-hydroxy-11-eicosenoic acid. The preferred di-hydroxy substituted monocarboxylic acid is 9,10-dihydroxy-stearic acid.

The reaction of the metal based material (B1) with the carboxylic acid or its ester (B2) to form the thickener (B) is conducted in the base oil (A). The equivalent ratio of (B1):(B2) is from about 1:0.70–1.10 and the weight ratio of the base oil to the sum of the metal based material and the carboxylic acid is from 50:50 to 95:5.

In obtaining the composition of this invention, two different processes are envisioned. In the first process, a grease is prepared that involves the steps of (a) mixing (A) a base oil, (B1) a metal based material, and (B2) a carboxylic acid or its ester, wherein the equivalent ratio of (B1):(B2) is from about 1:0.70–1.10 and wherein the weight ratio of the base oil (A) to the sum of the metal based material and the carboxylic acid or its ester is from 50:50 to 95:5, thereby providing a mixture;

(b) heating said mixture to a temperature of from about 82° to about 105° C. to form (B);

(c) heating the mixture to a final temperature of about 145° C. for an alkaline earth metal or to about 200° C. for an alkali metal; and (d) cooling the mixture to form a grease.

The second process of this invention involves the steps of (a) mixing a first portion of (A) a base oil, (B1) a metal based material, and (B2) a carboxylic acid or its ester, wherein the equivalent ratio of (B1):(B2) is from about 1:0.70–1.10 and wherein the weight of (A) to the sum of (B1) and (B2) is from 50:50 to 90:10; thereby providing a first mixture;

(b) heating said first mixture to a temperature of from about 820° to about 105° Celsius to form (B), thereby providing a first heated mixture;

(c) heating the first heated mixture to a final temperature of about 145° C. for an alkaline metal or to about 200° C. for an alkali metal;

(d) adding at 110°–145° C. for an alkaline earth metal or 170°–200° C. for an alkali metal, subsequent portions of (A)

said base oil wherein the weight ration of the first portion of the base oil to the second portion of the base oil is from 50:50 to 95:5, and wherein the weight ratio of the base oil to the sum of the metal based material and the carboxylic acid or its ester is from 50:50 to 95:5, to provide a second mixture; and (e) permitting this mixture to a cool to form a grease.

In the above processes, components (A), (B1) and (B2) are as earlier defined.

The following examples illustrate the grease compositions and processes of this invention. Temperatures, unless indicated otherwise, are in degrees Celsius.

EXAMPLE 1

Charged to a Hobart mixer are 2,500 parts Sunyl 80 oil and 360 parts (1.2 equivalents) of 12-hydroxystearic acid. The contents are stirred and heated to 82° C. and added is 49 parts (1.3 equivalents) of calcium hydroxide. The temperature is raised to 140° C. and water is removed over a 2 hour period. A grease forms at about 60° C. and the contents are milled.

EXAMPLE 2

The procedure of Example 1 is essentially followed except that 2,000 parts rapeseed RS80 oil is utilized in place of the Sunyl 80 oil.

EXAMPLE 3

The procedure of Example 1 is essentially followed except that 358 parts (1.2 equivalents) of ricinoleic acid is utilized in place of the 12-hydroxystearic acid.

EXAMPLE 4

The procedure of Example 1 is essentially followed except that an equal amount of 16-hydroxystearic acid is utilized in place of the 12-hydroxystearic acid.

EXAMPLE 5

The procedure of Example 1 is essentially followed except that 48 parts (1.14 equivalents) of lithium hydroxide monohydrate is utilized in place of the calcium hydroxide. The temperature is raised to 200° C. and water is removed over a 2 hour period. A grease forms upon cooling and the contents are milled.

EXAMPLE 6

Charged to a Hobart mixer are 2,300 parts Sunyl 80 oil and 447 parts (1.5 equivalents) of ricinoleic acid. The contents are stirred and heated to 85° C. and added is 60 parts (1.6 equivalents) of calcium hydroxide. The temperature is raised to 140° C. and water is removed over a 2 hour period. A grease forms at about 60° C. and the contents are milled.

EXAMPLE 7

The procedure of Example 6 is essentially followed except that 131 parts ( 1.5 equivalents) of suberic acid is utilized in place of the ricinoleic acid.

EXAMPLE 8

Charged to a Hobart mixer is 1,905 parts Sunyl 80 oil and 360 parts (1.2 equivalents) of 12-hydroxystearic acid. The contents are heated to 82° C. and added is 49 parts (1.3 equivalents) of calcium hydroxide. The temperature is raised to 140° C. and water is removed over a 0.5 hour period. At 100° C. 386 parts Sunyl 80 oil is added. Grease formation occurs at about 60° C. and the contents are milled.

EXAMPLE 9

The procedure of Example 8 is essentially followed except that all the Sunyl oil is replaced with rapeseed oil.

EXAMPLE 10

Charged to a Hobart mixer is 1,500 parts sulfurized Sunyl 80® oil available from Hornett Brothers and containing 10% by weight sulfur. Heating and stirring is begun and 324 parts (1.08 equivalents) of 12-hydroxystearic acid added. At 82° C. added is 44.4 parts (1.2 equivalents) of calcium hydroxide. At 99° C., 60 parts water is added in order to put the calcium hydroxide into solution. The water is then stripped out to a temperature of 140° C. and held at this temperature for 0.5 hours. The contents are cooled by adding 1,132 parts additional sulfurized Sunyl 80® oil to a temperature of 65° C. A grease is formed and the contents are milled.

EXAMPLE 11

Charged to a Hobart mixer is 2381 parts Sunyl 80 oil and 397 parts (1.29 equivalents) of 12-hydroxystearic acid. The contents are heated to 77° C. and added is a slurry of 69 parts (1.6 equivalents) lithium hydroxide in 120 parts water. The contents are heated to 103° C. while removing water. When all the water is removed, the temperature is slowly increased to 195° C. and held for 10 minutes. To the contents are slowly added 163 parts Sunyl 80 oil. Grease formation occurs upon cooling and the contents are milled.

EXAMPLE 12

The procedure of Example 11 is essentially followed except that all the Sunyl 80 oil is replaced with rapeseed oil.

EXAMPLE 13

The procedure of Example 11 is essentially followed except that the water is omitted.

Most of the grease tests that have been standarized define or describe properties that are related to the performance type tests in actual or simulated operating mechanisms. They provide considerable useful information about a grease. However, it must be recognized that they are laboratory tests and have their greatest value as screening tests which give directional indications of what can be expected when a grease is placed in service in a specific application, and as physical standards for manufacturing control. Direct correlation between laboratory tests and field performance is rarely possible since the tests never exactly duplicate service conditions, and service conditions are never identical even in two outwardly similar applications. For these reasons, an understanding of the intent and significance of the tests is essential for those involved with the use of lubricating grease.

The grease compositions of this invention are evaluated in the following tests: unworked penetration, $P_0$; worked penetration $P_{60}$ and $P_{10K}$; dropping point; weld point and wear. Several of the above preferred greases have the following characteristics as shown in Table I.

TABLE I

| | Grease Characteristics | | | |
|---|---|---|---|---|
| Test/Example | 8 | 9 | 11 | 12 |
| $P_0$ | 238 | 240 | 336 | 363 |
| $P_{60}$ | 260 | 259 | 331 | 362 |
| $P_{10K}$ | 296 | 303 | 292 | 328 |
| Dropping Point | 121° C. | 121 | 187 | 185 |
| Weld Point | 126 Kg | 126 | 126 | 160 |
| Wear | 0.43 mm | 0.45 | 0.67 | 0.67 |

While the invention been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An environmentally friendly lubricating grease, comprising;

(A) a base oil wherein the base oil is a natural oil or synthetic triglyceride of the formula

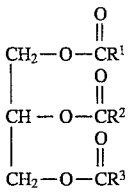

wherein $R^1$, $R^2$ and $R^3$ are aliphatic groups that contain from about 7 to about 23 carbon atoms and (B) a thickener wherein the thickener (B) is a reaction product of (B1) a metal based material and (B2) a carboxylic acid or its ester, wherein the metal based material (B1) comprises a metal oxide, metal hydroxide, metal carbonate or metal bicarbonate, wherein the metal is an alkali or alkaline earth metal and wherein the carboxylic acid (B2) is of the formula $R^4(COR^5)_n$ wherein $R^4$ is an aliphatic group that contains from 4 to about 29 carbon atoms, $R^5$ is hydrogen or an aliphatic group containing from 1 to 4 carbon atoms and n is an integer of from 1 to 4.

2. The lubricating grease of claim 1 wherein the alkali metals comprise lithium, sodium or potassium.

3. The lubricating grease of claim 1 wherein the alkaline earth metals comprise magnesium, calcium or barium.

4. The lubricating grease of claim 1 wherein (B1) is lithium hydroxide.

5. The lubricating grease of claim 1 wherein (B1) is calcium hydroxide.

6. The lubricating grease of claim 1 wherein within (B2), $R^4$ contains from 12 to 24 carbon atoms and n is 1 or 2.

7. The lubricating grease of claim 1 wherein $R^5$ is hydrogen and the carboxylic acid is a monocarboxylic acid.

8. The lubricating grease of claim 1 wherein $R^5$ is hydrogen and the carboxylic acid is a mono- or di-hydroxy monocarboxylic acid.

9. The lubricating grease of claim 8 wherein within (B2) the mono-hydroxy monocarboxylic acids comprise 6-hydroxystearic acid, 12-hydroxystearic acid, 14-hydroxystearic acid, 16-hydroxystearic acid, ricinoleic acid or 14-hydroxy-11-eicosenoic acid.

10. The lubricating grease of claim 8 wherein (B2) is the di-hydroxy monocarboxylic acid comprising 9,10-dihydroxystearic acid.

11. The lubricating grease of claim 1 wherein the equivalent ratio of (B1):(B2) is from 1:0.70–1.10.

12. The lubricating grease of claim 1 wherein the natural oil is a vegetable oil comprising sunflower oil, safflower oil, corn oil, soybean oil, rapeseed oil, coconut oil, lesquerella oil, castor oil, canola oil or peanut oil.

13. The lubricating grease of claim 1 wherein the synthetic triglyceride is an ester of at least one straight chain fatty acid and glycerol wherein the fatty acid contains from 8 to 24 carbon atoms.

14. The lubricating grease of claim 13 wherein the fatty acid is oleic acid, linoleic acid, linolenic acid or mixtures thereof.

15. The lubricating grease of claim 1 wherein the natural oil is a genetically modified vegetable oil wherein $R^1$, $R^2$ and $R^3$ are aliphatic groups having a monounsaturated character of at least 60 percent.

16. The lubricating grease of claim 15 wherein the monounsaturated character of the genetically modified vegetable oil is due to an oleic acid residue wherein an oleic acid moiety:linoleic acid moiety ratio is from 2 up to 90.

17. The lubricating grease of claim 16 wherein the monounsaturated character is at least 70 percent.

18. The lubricating grease of claim 16 wherein the monounsaturated character is at least 80 percent.

19. The lubricating grease of claim 16 wherein the genetically modified vegetable oil comprises genetically modified sunflower oil, genetically modified corn oil, genetically modified soybean oil, genetically modified rapeseed oil, genetically modified canola oil, genetically modified safflower oil or genetically modified peanut oil.

20. A lubricating grease of claim 16 wherein the genetically modified vegetable oils are sulfurized genetically modified vegetable oils.

21. The lubricating grease of claim 20 wherein the sulfurized genetically modified vegetable oil contains from 5 to 15 percent sulfur.

22. The lubricating grease of claim 20 wherein the sulfurized genetically modified vegetable oil contains from 8.5 to 11.5 percent sulfur.

23. A process for preparing an environmentally friendly grease, comprising the steps of (a) mixing (A) a base oil wherein the base oil is a natural oil or synthetic triglyceride of the formula

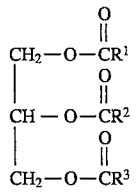

wherein $R^1$, $R^2$ and $R^3$ are aliphatic groups that contain from about 7 to about 23 carbon atoms, (B1) a metal based material wherein the metal based material comprises a metal oxide, metal hydroxide, metal carbonate or metal bicarbonate wherein the metal is an alkali or alkaline earth metal, and (B2) a carboxylic acid or its ester, wherein the carboxylic acid is of the formula $R^4(COOR^5)_n$ wherein $R^4$ is an aliphatic group that contains from 4 to about 29 carbon atoms, $R^5$ is hydrogen or an aliphatic group containing from 1 to 4 carbon atoms and n is an integer of from 1 to 4, wherein the equivalent ratio of (B1):(B2) is from about 1:0.70–1.10 and wherein the weight ratio of the base oil to the sum of the metal based material and the carboxylic acid is from 50:50 to 95:5, thereby providing a mixture;

(b) heating said mixture to a temperature of from about 82° to about 105° C. to form (B);

(c) heating the mixture to a final temperature of about 145° C. for an alkaline metal or to about 200° C. for an alkali metal; and (d) cooling the mixture to form a grease.

24. The process of claim 23 wherein (B1) is lithium hydroxide or calcium hydroxide.

25. The process of claim 23 wherein (B2) is a mono-hydroxy monocarboxylic acid.

26. The process of claim 25 wherein the mono-hydroxy mono-carboxylic acid comprises 6-hydroxystearic acid, 12-hydroxystearic acid, 14-hydroxystearic acid, 16-hydroxystearic acid, ricinoleic acid or 14-hydroxy-11-eicosenoic acid.

27. The process of claim 23 wherein the natural oil is a vegetable oil comprising sunflower oil, safflower oil, corn oil, soybean oil, rapeseed oil, coconut oil, lesquerella oil, castor oil, canola oil or peanut oil.

28. The process of claim 23 wherein the natural oil is a genetically modified vegetable oil wherein $R^1$, $R^2$ and $R^3$ are aliphatic groups having a monounsaturated character of at least 60 percent.

29. The process of claim 28 wherein the monounsaturated character is due to an oleic acid residue wherein an oleic acid moiety:linoleic acid moiety ratio is from 2 up to 90.

30. The process of claim 23 wherein the monounsaturated character is at least 70 percent and the genetically modified vegetable oil comprises genetically modified sunflower oil, genetically modified corn oil, genetically modified soybean oil, genetically modified rapeseed oil, genetically modified canola oil, genetically modified safflower oil or genetically modified peanut oil.

31. The process of claim 30 wherein the genetically modified vegetable oils are sulfurized genetically modified vegetable oils.

32. The process of claim 31 wherein the sulfurized genetically modified vegetable oil contains from 5 to 15 percent sulfur.

33. The process of claim 31 wherein the sulfurized genetically modified vegetable oil contains from 8.5 to 11.5 percent sulfur.

34. A process for preparing an environmentally friendly grease, comprising the steps of (a) mixing a first portion of (A) a base oil wherein the base oil is a natural oil or synthetic triglyceride of the formula

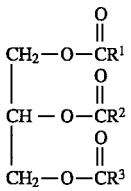

wherein $R^1$, $R^2$ and $R^3$ are aliphatic groups that contain from about 7 to about 23 carbon atoms, (B1) a metal based material wherein the metal based material comprises a metal oxide, metal hydroxide, metal carbonate or metal bicarbonate wherein the metal is an alkali or alkaline earth metal, and (B2) a carboxylic acid or its ester, wherein the carboxylic acid is of the formula $R^4(COOR^5)_n$ wherein $R^4$ is an aliphatic group that contains from 4 to about 29 carbon atoms, $R^5$ is hydrogen or an aliphatic group that contains from 1 to 4 carbon atoms and n is an integer of from 1 to 4, wherein the equivalent ratio of (B1):(B2) is from about 1:0.70–1.10; thereby providing a first mixture;

(b) heating said first mixture to a temperature of from about 82° to about 105° C. to form (B), thereby providing a first heated mixture;

(c) heating the first heated mixture to a final temperature of about 145° C. for an alkaline metal or to about 200° C. for an alkali metal;

(d) adding at 110°–145° C. for an alkaline earth metal or 170°–200° C. for an alkali metal, subsequent portions of (A) said base oil wherein the weight ration of the first portion of the base oil to the second portion of the base oil is from 50:50 to 95:5, and wherein the weight ratio of the base oil to the sum of the metal based material and the carboxylic acid is from 50:50 to 95:5, to provide a second mixture; and (e) permitting this mixture to cool to form a grease.

35. The process of claim 34 wherein (B1) is lithium hydroxide or calcium hydroxide.

36. The process of claim 34 wherein (B2) is a mono-hydroxy monocarboxylic acid.

37. The process of claim 36 wherein the mono-hydroxy mono-carboxylic acid comprises 6-hydroxystearic acid, 12-hydroxystearic acid, 14-hydroxystearic acid, -hydroxystearic acid, ricinoleic acid or 14-hydroxy-11-ercosenoic acid.

38. The process of claim 34 wherein the natural oil is a vegetable oil comprising sunflower oil, safflower oil, corn oil, soybean oil, rapeseed oil, coconut oil, lesquerella oil, castor oil, canola oil or peanut oil.

39. The process of claim 34 wherein the natural oil is a genetically modified vegetable oil wherein $R^1$, $R^2$ and $R^3$ are aliphatic groups having a monounsaturated character of at least 60 percent.

40. The process of claim 39 wherein the monounsaturated character is due to an oleic acid residue wherein an oleic acid moiety:linoleic acid moiety ratio is from 2 up to 90.

41. The process of claim 34 wherein the monounsaturated character is at least 70 percent and the genetically modified vegetable oil comprises genetically modified sunflower oil, genetically modified corn oil, genetically modified soybean oil, genetically modified rapeseed oil, genetically modified canola oil, genetically modified safflower oil or genetically modified peanut oil.

42. The process of claim 41 wherein the genetically modified vegetable oils are sulfurized genetically modified vegetable oils.

43. The process of claim 42 wherein the sulfurized genetically modified vegetable oil contains from 5 to 15 percent sulfur.

44. The process of claim 42 wherein the sulfurized genetically modified vegetable oil contains from 8.5 to 11.5 percent sulfur.

* * * * *